US009147380B2

(12) United States Patent
Jones

(10) Patent No.: US 9,147,380 B2
(45) Date of Patent: Sep. 29, 2015

(54) SHAPED ROSIN AND PROTECTIVE FABRIC

(71) Applicant: Christopher Jones, New Haven, CT (US)

(72) Inventor: Christopher Jones, New Haven, CT (US)

( * ) Notice: Subject to any disclaimer, the term of this patent is extended or adjusted under 35 U.S.C. 154(b) by 0 days.

(21) Appl. No.: 13/793,307

(22) Filed: Mar. 11, 2013

(65) Prior Publication Data

US 2013/0233151 A1 Sep. 12, 2013

Related U.S. Application Data

(60) Provisional application No. 61/609,551, filed on Mar. 12, 2012.

(51) Int. Cl.
*G10D 3/00* (2006.01)
*G10D 3/16* (2006.01)

(52) U.S. Cl.
CPC ... *G10D 3/00* (2013.01); *G10D 3/16* (2013.01)

(58) Field of Classification Search
CPC ..... G10G 5/00; G10D 3/00; G10D 1/005; G10D 3/16
USPC ..... 84/453, 327, 329
See application file for complete search history.

(56) References Cited

U.S. PATENT DOCUMENTS 5,002,180 A * 3/1991 Franz ..... 206/14

OTHER PUBLICATIONS http://rockinrosin.com, Jackson, Jul. 17, 2013.*

* cited by examiner

*Primary Examiner* — Kimberly Lockett

(57) ABSTRACT

A fanciful shaped rosin and protective element for use in connection with the bow of a stringed instrument, wherein said fanciful shape is selected from one or more of the following shapes: heart, star, flower, plant, cross, letter, number, animal, football, soccer balls, baseball, basketball, human shape, shamrock, skull, Christmas tree, wreath, six pointed star, crucifix, planet, crescent moons, clef symbols, notes, rests, fermata, punctuation symbols, QWERTY keyboard symbols, percent symbol, ampersand, LOL, and a smiley face. The protective element preferably comprises a protective fabric attached to said rosin.

6 Claims, 2 Drawing Sheets

SHAPED ROSIN AND PROTECTIVE FABRIC

CROSS REFERENCE TO RELATED APPLICATIONS

This application claims the benefit of U.S. provisional patent application Ser. No. 61/609,551 filed Mar. 12, 2012, the content of which is incorporated herein by reference in its entirety.

FIELD OF THE INVENTION

This invention relates to rosins used to apply to the bows of stringed instruments.

BACKGROUND

Rosin is typically available in cylindrical shapes, circular shapes or rectangular shapes, and are referred to as rosin cakes. Examples of such rosin cakes are found in U.S. Pat. No. 1,098,277, U.S. Pat. No. 4,515,272 and U.S. Pat. No. 5,002,180. While practical, such shapes do little to inspire youthful string musicians in training. Musical instruction is often aided by products and activities intended to increase the interest of youthful students. Moreover, rosin cakes are extremely brittle and can easily break apart upon a shock or other impact. Such known rosin cake shapes identified above do not encourage youthful musicians to extend the required care and attention needed to preserve and protect the rosin from breaking.

SUMMARY

This invention provides interesting and fanciful shaped rosins for youthful stringed instrument musicians together with a protective element such as a fabric wrap or an inflexible protector to help prevent damage and breakage to the shaped rosin. A method is also provided in this invention for creating such interesting and fanciful shaped rosins with fabric or inflexible protectors.

DETAILED DESCRIPTION

Figure 1:
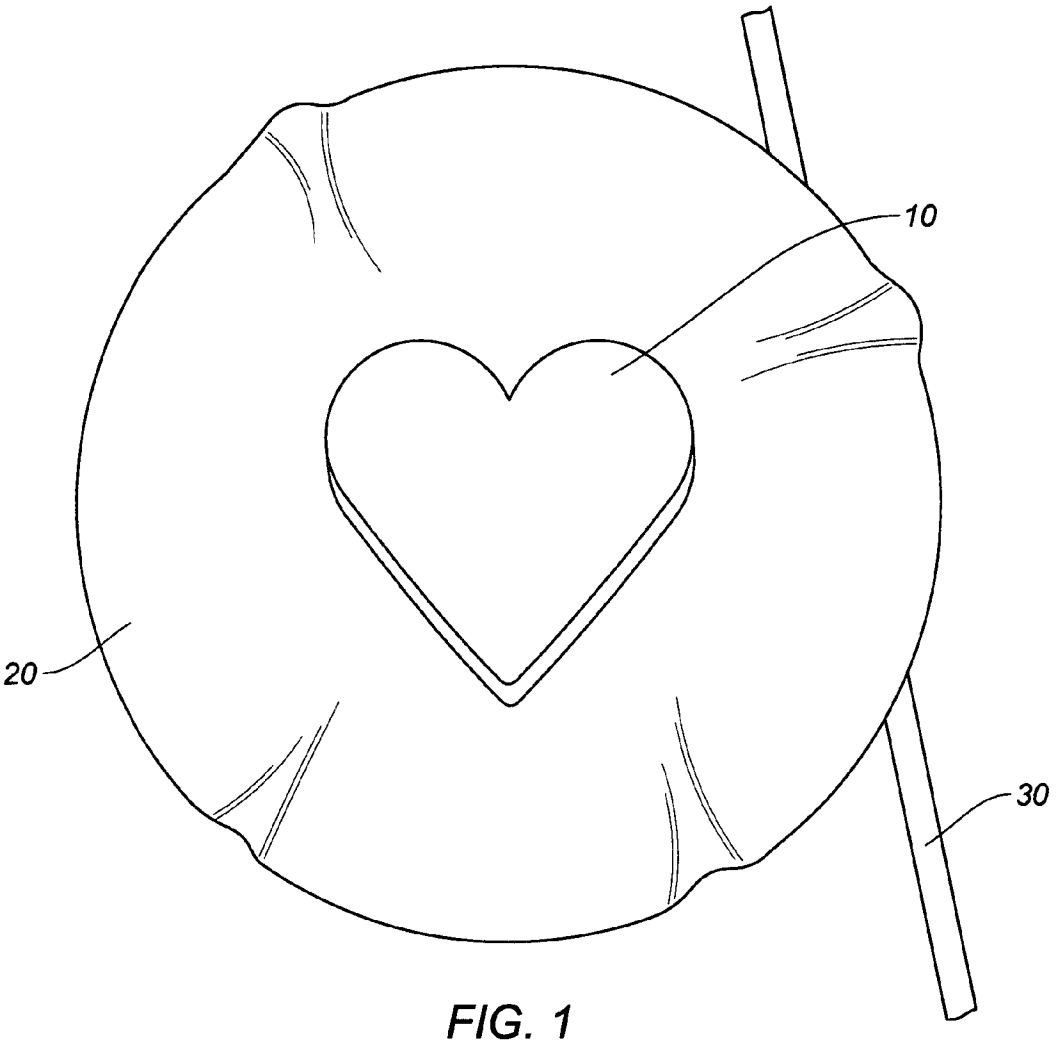
FIG. 1 is an embodiment of the shaped rosin of the present invention.

FIG. 1 shows a fanciful shaped rosin 10 of the present invention, in the shape of a heart. The shaped fanciful shaped rosin 10 is attached to a protective element such as the protective cloth 20 of the present invention. A ribbon 30 is preferably attached to the protective cloth 20 for securing the protective cloth about the fanciful shaped rosin 10 of the within invention when the rosin is not in use.

Figure 2:
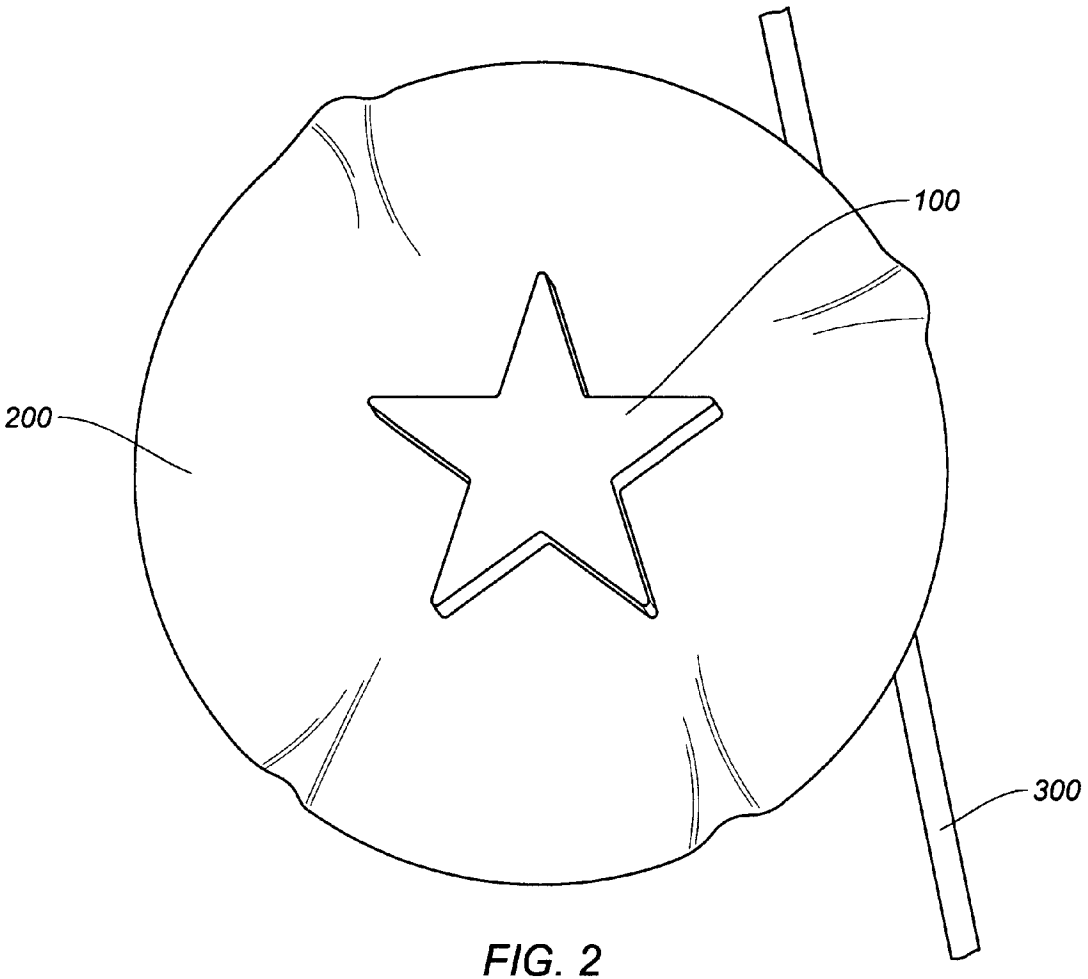
FIG. 2 is a second embodiment of the shaped rosin of the present invention.

FIG. 2 shows an alternate fanciful shaped rosin 100 of the present invention, in the shape of a star, again affixed or attached to a protective element such as the protective cloth 200. As used in the within application, the term "fanciful shape" refers to a shape other than a cylinder, rectangular block, or a circular shape.

Fanciful shapes include, but are not limited to, hearts, stars, flowers, plants, crosses, letters and numbers, singularly or in combination, animal shapes, sports shapes such as footballs, soccer balls and basketballs, human shapes, holiday-inspired shapes such as shamrocks, skulls and Christmas trees, religious shapes or symbols such as a six pointed star or a crucifix, celestial shapes such as Saturn with its rings or a crescent moon, musical shapes such treble clefs, bass clefs, notes, rests, fermata, punctuation symbols such as exclamation points and question marks, and symbols found on a standard QWERTY keypad such as an ampersand, a dollar sign, a pound sign, a percent Symbol, a @ symbol, and texting and messaging symbols such as "LOL" and a smiley face.

The protective cloth 20 and 200 of the present invention can be in a wide variety of shapes, and is sized to enable the entire surface of the rosin 10 and 100 to be covered when the rosin is not in use, and can be deflected away from the rosin when the rosin is in use. In a preferred embodiment, the protective fabric pattern, or the shape of the protective fabric, or both, coordinate with the fanciful shaped rosin to create a theme. For example, an embodiment of the within invention featuring a star-shaped rosin would include a protective fabric having a star incorporated into the pattern of the fabric, or a star-shaped protective fabric, or both. In this embodiment, the protective element is a unitary flexible fabric that can not only be permanently affixed to the base of the rosin and deflected out of the way when the rosin is used, but can also be manipulated to surround and protect the entire surface area of the rosin as the rosin is depleted through use.

In an alternative embodiment (not shown), the protective element comprises an inflexible base material permanently attached to the rosin and joined with an inflexible cover. The inflexible base material is made of plastic, wood, or other material. The inflexible base is permanently attached to the rosin by an adhesive, by heat treating the rosin as described further below to form a bond, or by other suitable method as is known in the art. The inflexible base is joined with a protective lid that surrounds the entire surface area of the rosin when the rosin is not in use. The inflexible base can be permanently joined to the cover via a hinge or other suitable joint that allows the cover to be deflected when the rosin in use. The inflexible base can also be joined with the cover via screws or other means known in the art allowing the cover to be separated from the base when the rosin is in use. The inflexible base and cover together form the protective element of the within invention.

In the preferred embodiment of the within invention, ribbon 30 of FIG. 1 or ribbon 300 of FIG. 2 is attached to the protective cloth by one or more sewing stitches. Other attachment methods can be utilized for attaching the ribbon 30 or 300 without departing from the within invention. Such alternate attachment methods include, for example, passing one end of the ribbon through one or more openings in the protective cloth 20 or 200 and tying the ribbon to the cloth, leaving ribbon ends long enough to further secure the protective cloth 20 or 200 around the rosin when not in use. The function of the ribbon 30 or 300 is to secure the protective fabric about the exterior of the shaped rosin by tying the ribbon when the rosin is not in use. As such, it will be appreciated that alternate securing means may be utilized for securing the protective fabric about the exterior of the shaped rosin, and that the term "ribbon" includes but is not limited to, alternate tying materials such as string or thread or rope or elongated fabric. Alternate means of securing the fabric about the rosin when the rosin is not in use include snaps, Velcro, hooks and eyes, and other connection mechanisms as are known in the art.

In the preferred embodiment, the fanciful shaped rosin 10 or 100 is attached to the protective fabric 20 or 200 such that even when the ribbon is not tied, the rosin and the fabric are attached. Typically this is accomplished by a bond formed between the rosin in its fluid state and the fabric as will be explained further below. Once the rosin cools, it takes a solid form and bonds to the fabric.

The fanciful shaped rosin of the within invention can be made using starting material of either raw tree sap that is collected by tapping a tree and is then refined, bulk rosin flake material or, in the alternative, existing rosin cakes. Bulk rosin flake material can be obtained from a chemical supplier such as Chemical Store Inc. through its website chemicalstore-.com. Preferably the material is at least WW grade, and the preferred starting material is Gum Rosin Flakes, Brazilian, WW Grade. It is also possible to start with existing solid cakes of rosin without departing from the within invention.

The starting material is then heated until reaching its melting temperature, where the material becomes a flowable fluid. This can be done on a stove or other conventional heating appliance readily available. Once the material is in a flowable fluid state, it is poured into molds to create the fanciful shaped rosin. The molds are silicone or other material that allows for intact removal of the rosin from the mold. Such molds are available from a wide variety of sources including but not limited to kitchen supply establishments. Such molds may also be created using a mold creating method such as "TAP Silicone RTV Mold-Making System" available from tapplastics.com.

It will be appreciated that the step of forming the fanciful shaped rosin can further include additions that enhance the ability to add decorative features to the fanciful shaped rosin 10. For example, the insertion of silicone coated shapes into an external mold and surrounding those shapes with fluid rosin will create voids or detents in the rosin once the rosin solidifies and the silicone coated shapes are removed from the molded rosin. These voids or detents can then be filled with a non-reactive inert material such as a molten colored wax that adds additional features, dimension and detail to the fanciful shaped rosin. For example, a fanciful shaped rosin in the shape of a skull can include contrasting colored eyes visible through the transparent rosin. The contrasting eyes can be created by creating a void or detent as described above, and then filling the detent or void with molten wax until it hardens. It will be appreciated that other objects can be inserted into the mold to create voids and detents so long as they can be removed once the rosin hardens. It will further be appreciated that non-removable objects can also be added to the fluid rosin in the mold prior to solidifying, for permanent incorporation into the fanciful shaped rosin to add further decorative interest, without deviating from the scope of the within invention.

In a further embodiment of the within invention, the fanciful shapes as described above are incorporated into a rosin cake by the creation of voids and detents in an external mold as described above. Thus, for example, a star can be created by inserting one or more removable star shaped silicone coated objects into an external mold, adding the fluid rosin to the mold, and removing the inserted star shaped object or objects once the rosin has solidified. The star-shaped void is then filled with a non-reactive inert material such as a wax, enabling the star shape to be visible through the translucent rosin. It will be appreciated that several different fanciful shapes can be incorporated into a single rosin cake in this embodiment. The external mold may or may not also incorporate a fanciful shape as described above.

Once the fluid rosin has solidified, it is removed from the mold and further allowed to equilibrate to room temperature. While cooling, the rosin is subjected to a heat source such as is provided from a blowtorch or heat gun, which brings out the glassy translucence of the rosin.

The desired protective element is also attached to the fanciful shaped rosin. This can be accomplished by applying additional heated fluid rosin to one or more surfaces of the solid rosin and quickly pressing the protective element to the rosin. In the alternative, the surface of the solid fanciful shaped rosin that is to be attached to the protective element can be re-heated, using a blowtorch, heat gun or other such tool, to the point where this surface is partially fluid, and again quickly pressed into contact with the protective element.

In the embodiment where the protective element is a flexible unitary fabric material, a ribbon or other means of securing the fabric protective element about the rosin such as Velcro, snaps, hooks and eyes is preferably attached to the protective fabric as described above. This can be accomplished before or after attaching the fanciful shaped rosin to the protective fabric.

Thus it has been shown how to create a fanciful shaped rosin and protective element to engage the interest of the youthful music student.

The invention claimed is:

1. A fanciful shaped rosin and protective element for use in connection with the bow of a stringed instrument wherein said fanciful shape is selected from one or more of the following shapes: heart, star, flower, plant, cross, letter, number, animal, football, soccer balls, baseball, basketball, human shape, shamrock, skull, christmas tree, wreath, six pointed star, crucifix, planet, crescent moons, clef symbols, notes, rests, fermata, punctuation symbols, QWERTY keyboard symbols, percent symbol, ampersand, LOL, and a smiley face and wherein said protective element comprises an inflexible base attached to said rosin and an inflexible cover.

2. The fanciful shaped rosin of claim 1 wherein said base and said cover are permanently connected to each other.

3. A fanciful shaped rosin and protective element for use in connection with the bow of a stringed instrument wherein said fanciful shape is selected from one or more of the following shapes: heart, star, flower, plant, cross, letter, number, animal, football, soccer balls, baseball, basketball, human shape, shamrock, skull, christmas tree, wreath, six pointed star, crucifix, planet, crescent moons, clef symbols, notes, rests, fermata, punctuation symbols, QWERTY keyboard symbols, percent symbol, ampersand, LOL, and a smiley face and wherein said fanciful shape is created within said rosin cake and wherein said protective element comprises an inflexible base attached to said rosin and an inflexible cover.

4. A method of making a fanciful shaped rosin, said method comprising the steps of heating solid rosin until it melts, pouring the fluid rosin into a fanciful shaped mold, cooling said rosin, removing said fanciful shaped rosin from said mold, applying heat to said rosin while cooling to create a glassy translucence, and attaching a protective element to said fanciful shaped rosin.

5. The method of claim 4, wherein the step of attaching said protective element further comprises the step of joining protective fabric to liquid rosin so as to permanently join the fanciful shaped rosin and said fabric once the rosin solidifies.

6. The method of claim 4, wherein the step of attaching said protective element further comprises the step of joining an inflexible base to liquid rosin so as to permanently join the fanciful shaped rosin and the inflexible base once the rosin solidifies.

* * * * *